US006981665B2

(12) United States Patent
Braun et al.

(10) Patent No.: US 6,981,665 B2
(45) Date of Patent: Jan. 3, 2006

(54) CONE CRUSHER BOWL ADJUSTMENT MECHANISM

(75) Inventors: Thomas G. Braun, Muskego, WI (US); Dean M. Kaja, Germantown, WI (US); Mark K. Torbett, Big Bend, WI (US)

(73) Assignee: Metso Minerals Industries, Inc., Milwaukee, WI (US)

( * ) Notice: Subject to any disclaimer, the term of this patent is extended or adjusted under 35 U.S.C. 154(b) by 510 days.

(21) Appl. No.: 10/323,028

(22) Filed: Dec. 18, 2002

(65) Prior Publication Data

US 2003/0094520 A1 May 22, 2003

Related U.S. Application Data

(63) Continuation-in-part of application No. 09/506,530, filed on Feb. 17, 2000, now Pat. No. 6,513,738.

(51) Int. Cl.
*B02C 25/00* (2006.01)

(52) U.S. Cl. ..... 241/30; 241/207; 241/286

(58) Field of Classification Search ..... 241/207–216, 241/30, 286

See application file for complete search history.

(56) References Cited

U.S. PATENT DOCUMENTS

| | | | |
|---|---|---|---|
| 3,666,188 A | 5/1972 | Lippmann | 241/213 |
| 4,717,084 A | 1/1988 | Vendelin et al. | 241/207 |
| 6,513,738 B1 | 2/2003 | Braun et al. | 241/30 |

OTHER PUBLICATIONS

Nordberg, "HP Series Cone Crusher Instruction Manual-Hydraulic Supplement".

Nordberg, "Omnicone Crushers", 1993 Nordberg Inc.

Nordberg, "Omnicone Crushers", 1988 Norberg Inc.

*Primary Examiner*—Mark Rosenbaum
(74) *Attorney, Agent, or Firm*—Foley & Lardner LLP

(57) ABSTRACT

A rock crusher includes a bowl coupled to a frame and a head assembly coupled to the frame defining a crushing gap between the head assembly and the bowl. The rock crusher further includes a number of fixed displacement hydraulic motors adapted to rotate the bowl with respect to the frame and a hydraulic fluid source providing a flow rate of hydraulic fluid to the hydraulic motors. A hydraulic control valve is adapted to remove one of the hydraulic motors from operation, directing the hydraulic fluid to the remaining hydraulic motors. The flow rate of hydraulic fluid remains unchanged, thereby increasing the hydraulic fluid flow rate provided to and the speed of the remaining hydraulic motors.

20 Claims, 4 Drawing Sheets

CONE CRUSHER BOWL ADJUSTMENT MECHANISM

CROSS-REFERENCE TO RELATED APPLICATIONS

This is a continuation-in-part of application Ser. No. 09/506,530, filed Feb. 17, 2000 now U.S. Pat. No. 6,513,738, which is incorporated herein by reference in its entirety.

FIELD OF THE INVENTION

The present invention relates generally to rock crushing equipment. More particularly, the present invention relates to a rock crusher capable of adjusting the crushing gap at more than one speed.

BACKGROUND OF THE INVENTION

A rock crushing system generally breaks apart rock, stone or other material in a crushing gap between two elements. For example, a conical rock crusher is comprised of a head assembly including a crushing head which gyrates about a vertical axis within a stationary bowl attached to a main frame of the rock crusher. The crushing head is assembled with an eccentric mechanism that rotates to impart the gyrational motion of the crushing head which crushes rock, stone or other material in a crushing gap between the crushing head and the bowl. The eccentric mechanism can be driven by a variety of power drives such as an attached bevel gear, driven by a pinion and counter shaft assembly, and a number of mechanical power sources, such as electrical motors or combustion engines.

The exterior of the conical crushing head is covered with a protective or wear resistant mantle that engages the material which is being crushed, such as rock, stone, ore, minerals or other substances. The bowl which is mechanically fixed to the main frame is fitted with a bowl liner. The bowl liner and the bowl are stationary and spaced apart from the crushing head. The liner provides an opposing surface from the mantle for crushing the material. The material is crushed in the crushing gap between the mantle and the liner.

The gyrational motion of the crushing head with respect to the bowl crushes rock, stone, or other material within the crushing gap. Generally, the rock, stone or other material is fed into a top of the crushing gap and is crushed as it travels through the crushing gap and exits at a bottom of the crushing gap. The size of the crushing gap determines the maximum size of crushed material which exits the crushing gap.

Generally, the bowl is movably attached to the adjustment ring which is connected to the main frame. The size of the crushing gap can be adjusted by vertically moving the bowl with respect to the crushing head. As the bowl vertically moves with respect to the adjustment ring and main frame, the bowl and bowl liner move vertically with respect to the mantle. A conventional crusher, such as, an HP700™ conical rock crusher manufactured by Metso Minerals of Milwaukee, Wis. includes a bowl threaded to an adjustment ring which is fixed to the main frame by tramp release cylinders. The bowl and connecting adjustment cap is coupled to a gear which surrounds the adjustment cap.

A conventional adjustment mechanism comprised of a hydraulic motor rotates the bowl with respect to the adjustment ring via the gear. The hydraulic motor rotates the bowl with respect to the main frame so that the bowl is vertically raised or lowered, thereby adjusting the gap size.

In another conventional crusher, an MP1000™ conical rock crusher manufactured by Metso Minerals of Milwaukee, Wis. includes an adjustment mechanism having four hydraulic motors. The four hydraulic motors are necessary to move the large bowl associated with the MP1000™ crusher. The four motors rotate the bowl with respect to the main frame to adjust the gap size.

Generally, the bowl must be moved with respect to the head in at least two different situations. First, the bowl is rotated with respect to the head to remove it from the rock crusher for repair and maintenance. Removing the bowl from the annular ring attached to the main frame requires a significant amount of time (e.g., over one hour) as the bowl is threadably disengaged from the annular ring. Alternatively, the bowl can be moved to various gap size heights to allow access and inspection of components of the rock crusher. Maintenance may include operations in which the mantle, crushing head, bowl liner, or bowl are repaired or replaced. Alternatively, other equipment in the crusher can be repaired and replaced or lubricated during maintenance operations. Generally, the bowl is removed when the rock crusher is not operational.

Second, the bowl is moved with respect to the head to adjust the gap size. The gap size is adjusted to alter the size of crushed material exiting the rock crusher. For example, to create crushed material which is smaller, the gap size is decreased. In contrast, to create crushed material which is larger, the gap size is increased. Generally, adjustments of the gap size to create smaller or larger size crushed material require relatively fine positioning of the bowl with respect to the crushing head (e.g., a slow rotation of the bowl with respect to the main frame is necessary).

The gap size can be adjusted while the rock crusher is operating (adjustment under load) or while the rock crusher is non-operational (no load). Adjustments under load require larger amounts of torque than the amount of torque required to adjust the bowl or remove the bowl under no load. Accordingly, conventional gap adjustment mechanisms have required a high torque, slow speed motor.

Certain conventional rock crushers, such as, the MP1000™ rock crusher have utilized two hydraulic pumps to drive the four hydraulic motors. The two hydraulic pumps allow the power unit to drive the four motors at two different speeds. One pump is used for the gap adjustments (e.g., slow speed), both pumps are used for installation and removal of the bowl assembly (e.g., high speeds). However, the use of two hydraulic pumps adds to the cost and size of the power unit.

Thus, there is a need for a low cost, an efficient variable speed gap adjustment mechanism. Further still, there is a need for a variable speed adjustment mechanism which does not require two hydraulic pumps.

SUMMARY OF THE INVENTION

The present invention relates to a method of adjusting a bowl with respect to a frame in a cone crusher, the method including the steps of providing a plurality of hydraulic motors adapted to rotate the bowl with respect to the frame and providing at least one hydraulic pump adapted to provide fluid to the hydraulic motors. Further steps include setting a first adjustment speed having a first torque by operating more than one motor and the at least one hydraulic pump and setting a second adjustment speed having a second torque by removing one of the operating motors from operation while maintaining operation of the hydraulic pump. The second adjustment speed is greater than the first adjustment speed and the second torque is less than the first torque.

The invention further relates to a cone crusher having a frame, a bowl coupled to the frame, a head assembly coupled to the frame defining a crushing gap between the head assembly and the bowl, and a plurality of fixed displacement hydraulic motors adapted to rotate the bowl with respect to the frame. The cone crusher further includes a hydraulic fluid source providing a flow rate of hydraulic fluid to the plurality of hydraulic motors, and a hydraulic control valve adapted to remove one of the plurality of hydraulic motors from operation, wherein the hydraulic fluid is directed to the remaining hydraulic motors and wherein the flow rate of hydraulic fluid remains unchanged, thereby increasing the hydraulic fluid flow rate provided to and speed of the remaining hydraulic motors.

Further still, the invention relates to a method of increasing the torque available for adjusting the crushing gap in a cone crusher having a bowl and a frame. The method includes the steps of providing more than one fixed displacement hydraulic motors adapted to rotate the bowl with respect to the frame, at least one of the hydraulic motors not operating, the remaining hydraulic motors being operating hydraulic motors. Further steps include providing a hydraulic fluid source to provide a flow rate of hydraulic fluid to the operating hydraulic motors and placing the not operating hydraulic motor into operation by providing a portion of the flow rate of hydraulic fluid to the not operating hydraulic motor, the flow rate of hydraulic fluid from the hydraulic fluid source remaining unchanged, thereby increasing the torque available for adjusting the crushing gap.

The invention is capable of other embodiments and of being practiced or being carried out in various ways. Alternative exemplary embodiments relate to other features and combinations of features as may be generally recited in the claims.

BRIEF DESCRIPTION OF THE DRAWINGS

Exemplary embodiments will hereinafter be described with reference to the accompanying drawings, wherein like numerals denote like elements and.

DETAILED DESCRIPTION OF THE PREFERRED EMBODIMENTS

Figure 1:
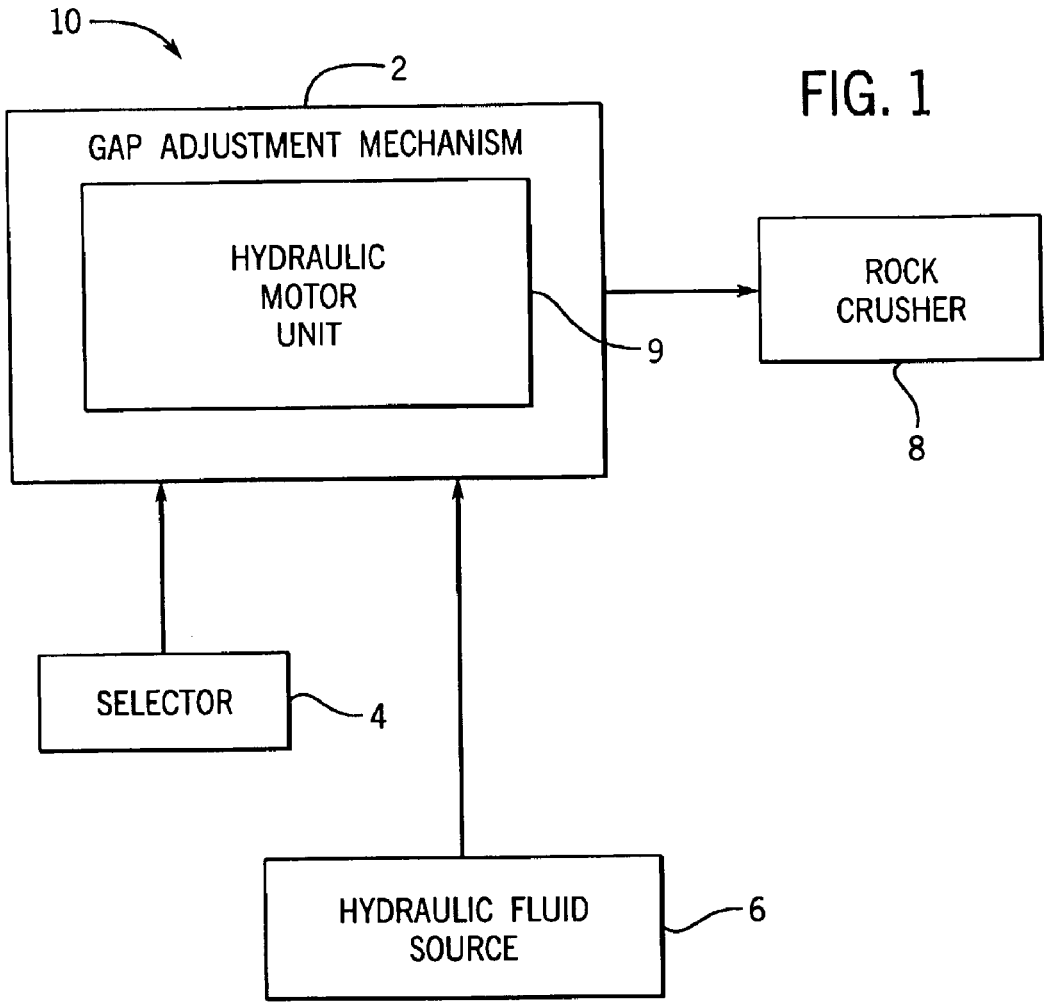
FIG. 1 is a general block diagram of a rock crushing system in accordance with an exemplary embodiment.

Referring to FIG. 1, a conical rock crusher or rock crushing system 10 includes a gap adjustment mechanism 2, a selector 4, a hydraulic fluid source 6, and a rock crusher 8. Gap adjustment mechanism 2 includes a hydraulic motor unit 9. Hydraulic motor unit 9 can include one or more hydraulic motors. Preferably, hydraulic motor unit 9 includes at least one variable displacement hydraulic motor.

Hydraulic fluid source 6 can be any fluid source for providing fluid under pressure. Hydraulic fluid source 6 can be a conventional hydraulic power unit composed of a cabinet with a self contained oil tank, an electric motor, a hydraulic pump, an accumulator, valves, gauges, and other necessary electrical and hydraulic components.

Selector 4 is a valve that selects the toned displacement of the motors and therefore ultimately determines torque and speed at which gap adjustment mechanism 2 adjusts the crushing gap associated with rock crusher 8.

Rock crusher 8 can be any type of rock crusher which utilizes a crushing gap. Preferably, crusher 8 has a crushing gap which is set via a rotational interface, such as, a bowl threadably engaged to a main frame. Rock crusher 8 can be HP™ series rock crusher, such as, the HP700 rock crusher, an MP series rock crusher, a WF Series rock crusher, or a Symons™ cone crusher manufactured by Metso Minerals of Milwaukee, Wis. Alternatively, rock crusher 8 can be any number of rock crushers manufactured by a variety of sources. Rock crusher 8 is not described in a limiting fashion with respect to the claims of the present application.

Gap adjustment mechanism 2 advantageously can adjust the crushing gap according to at least two speeds. Preferably, mechanism 2 has a higher speed, lower torque mode of operation for removing the bowl associated with rock crusher 8 and a higher torque, lower speed mode for adjusting the gap size associated with rock crusher 8 under load or for making finer adjustments to the crushing gap. The higher speed, lower torque mode is generally utilized in maintenance operations (no load conditions) and the lower speed, higher torque mode is generally utilized under load conditions.

Selector 4 can effectuate the selection of the appropriate speed for adjusting the gap associated with crusher 8 by adjusting the displacement setting associated with hydraulic motor unit 9. A higher displacement setting is utilized for a higher torque, lower speed mode and a lower displacement setting is used for a lower torque, higher speed mode. Additional displacement settings can provide additional torque speed modes.

Figure 2:
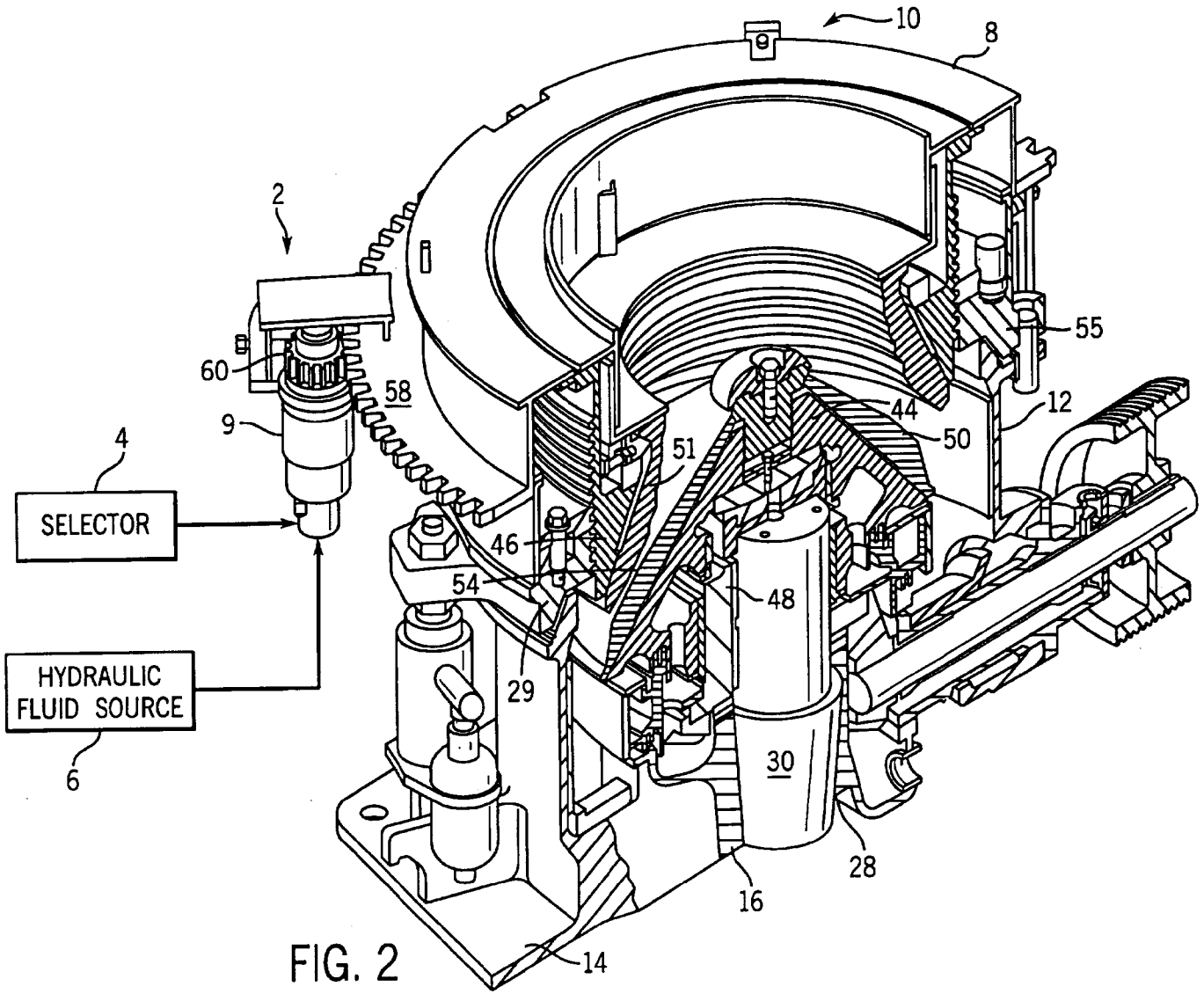
FIG. 2 is a perspective view, in partial cutaway, of the rock crushing system illustrated in FIG. 1.

Referring to FIG. 2, rock crusher 8 is embodied as a HP 700 rock crusher. Rock crusher 8 includes a structure or main frame 12 having a base 14. Crusher 8 can be any size rock crusher or any size of crusher head, such as a short head or a standard head. Base 14 rests upon a platform-like foundation which can include concrete piers (not shown), a foundation block, a platform, or other supporting members.

Central hub 16 of main frame 12 includes an upwardly diverging vertical bore or tapered bore 28. Bore 28 is adapted to receive a main shaft 30. Shaft 30 is preferably held stationary in bore 28 with respect to central hub 16 of frame 12.

Shaft 30 supports an eccentric mechanism 48 which is coupled to a head assembly 44. Eccentric mechanism 48 rotates about shaft 30, thereby causing head assembly 44 to gyrate within rock crushing system 10. The gyration of head assembly 44 within a bowl 46 which is fixed to adjustment ring 55 connected to main frame 12 allows rock, stone, ore, minerals, or other materials to be crushed between a mantle 50 and a bowl liner 51. Materials are crushed in a crushing gap 54. Bowl liner 51 is held against bowl 46, and mantle 50 is attached to head assembly 44. Head assembly 44 forces mantle 50 towards bowl liner 51 to effect the rock crushing operation.

Bowl 46 is threadably engaged to an adjustment ring 55 fixed to main frame 12. Bowl 46 is coupled to a gear 58 which is in communication with a gear 60 associated with hydraulic motor unit 9. System 10 preferably includes a second hydraulic motor unit 9 located ⅓ the arc distance along gear 58. A third hydraulic motor unit or a idler assembly can be utilized at ⅔ the arc distance along gear 58 to balance the loading along gear 58. Alternatively, system 10 can include any number of motor units 9. In another alternative embodiment, a single motor unit 9 can drive multiple gears 60.

The adjustment of the size of gap 54 is accomplished by rotating gear 60 via motor unit 9. Rotation of gear 60 rotates gear 58 which in turn rotates bowl 46 with respect to adjustment ring 55. In this embodiment, a counter-clockwise rotation of bowl 46 increases the size of gap 54, and a clockwise rotation of bowl 46 decreases the size of gap 54. Alternatively, ring 55 and bowl 46 may be configured such that a counter clockwise rotation of bowl 46 decreases the size of gap 54 and accordingly a clockwise rotation of bowl 46 increases the size of gap 54. Further, other interferences, threadable or otherwise adjustable, can be utilized to position bowl 46 with respect to assembly 44.

System 10 can advantageously rotate bowl 46 at more than one speed by utilizing a variable displacement hydraulic motor in unit 9. Selector 4 allows the speed to be chosen by adjusting the displacement setting for the variable displacement hydraulic motor. Preferably, unit 9, motors 122 and 124 (FIG. 3) can be set to a higher speed setting or a lower speed setting. Accordingly, motor unit 9 effectuates rotation of gear 60 and hence, the adjustment of gap 54 at two different speeds.

Figure 3:
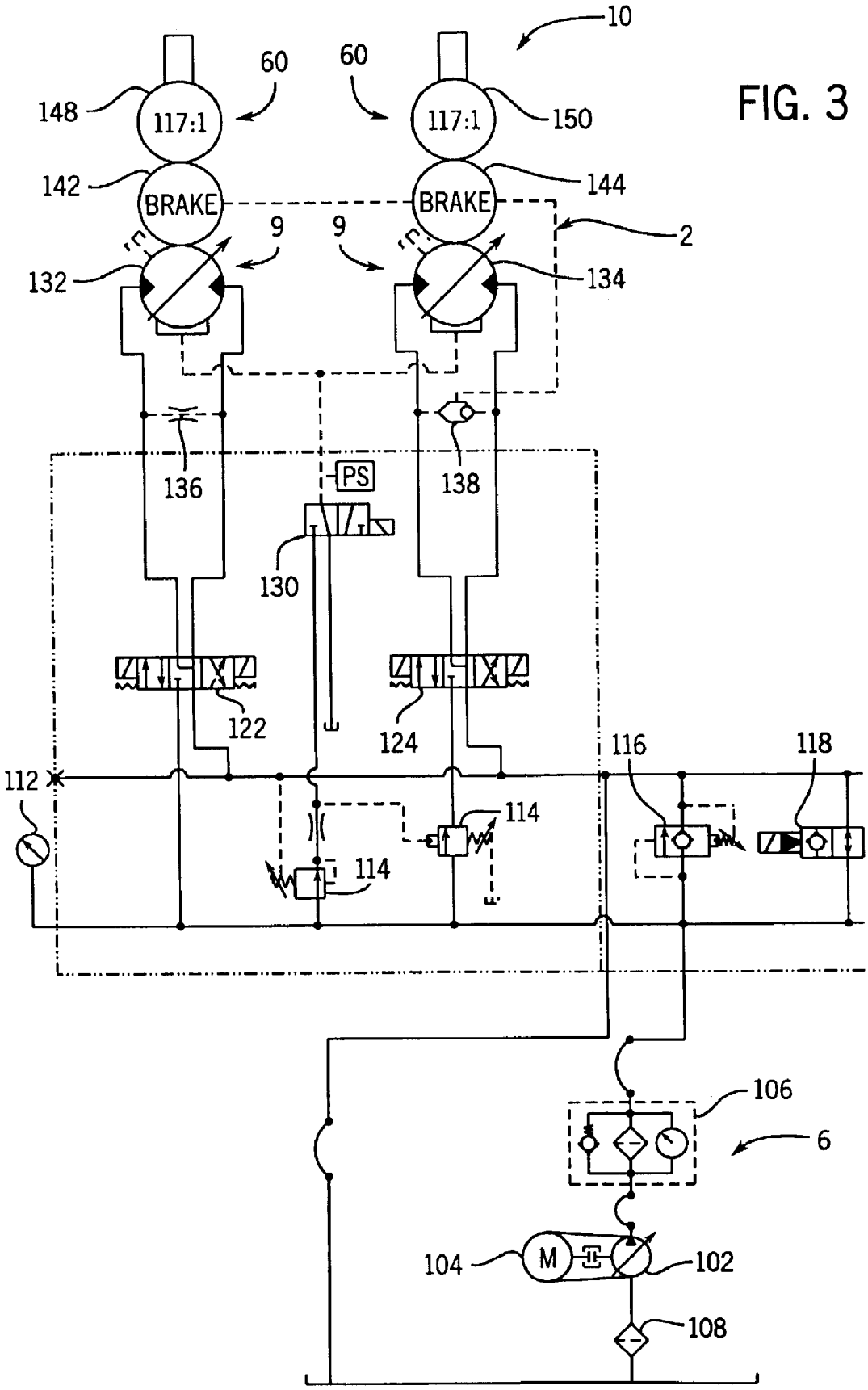
FIG. 3 is a detailed hydraulic schematic diagram of the rock crushing system illustrated in FIG. 1.

With reference to FIG. 3, the operation of gap adjustment mechanism 2 for conical crushing system 10 is described in more detail with respect to the hydraulic components. Hydraulic fluid source 6 includes a pump 102 driven by an electric motor 104. Pump 102 provides high pressure hydraulic fluid through high pressure in-line filter 106. Pump 102 draws hydraulic fluid through a magnetic suction separator 108 which can be a donut shaped ceramic magnet.

Gap adjustment mechanism 2 includes an overspeed protection apparatus 114, a gauge 112, a main relief valve 116, and an open loop valve 118. Open loop valve 118 is a neutral solenoid valve which removes pressure from mechanism 2 when power is lost. Mechanism 2 also includes directional control valves 122 and 124 for controlling the direction of rotation of high variable speed hydraulic motors 132 and 134. Valves 122 and 124 are preferably controlled by a solenoid and provide hydraulic fluid in a first direction to motors 132 and 134 when in a first position and provide hydraulic fluid in a second direction when in a second position. Motors 132 and 134 rotate in a direction corresponding to the direction of hydraulic fluid flowing through motors 132 and 134.

System 2 also includes a cross bleed orifice 136 and release shuttle 138. Shuttle 138 disengages brakes 142 and 144 on motors 132 and 134 when fluid is provided to motors 132 and 134. Cross bleed orifice 132 allows for error in the flow when variable displacement motor 132 is set to zero displacement as described below.

Motors 132 and 134 are variable displacement parallel feed motors. Alternatively, motors 132 and 134 can be piston motors or other hydraulic motors capable of variable displacement and zero stroke.

Motor 132 can be set to a zero displacement setting or a 2.8 cubic inches per revolution displacement setting. Motor 134 can be set to a displacement setting of 2.3 cubic inches per revolution and a displacement setting of 2.8 cubic inches per revolution.

The settings for motors 132 and 134 is controlled by a logic selector valve 130. Preferably, logic selector valve 130 is a solenoid valve which allows a user to select a high or low speed for mechanism 2. Valve 130 is preferably electrically coupled to a user interface (selector 4, FIG. 1) which allows the user to select a first displacement setting where motor 132 has a displacement of zero cubic inches per revolution and motor 134 has a displacement setting of 2.3 cubic inches per revolution or a second displacement setting where motor 132 has a displacement setting of 2.8 cubic inches per revolution and motor 134 has a displacement setting of 2.8 cubic inches per revolution.

When fluid is provided to motors 132 and 134, brakes 142 and 144 are disengaged via shuttle 138 and can rotate. When fluid is provided to one or both of motors 132 and 134, shafts 148 and 150, associated with gear 60 (FIG. 2) are rotated in the direction controlled by valves 122 and 124.

In operation, gap adjustment mechanism 2 is set to a higher speed, lower torque setting by setting motor 132 to the zero displacement setting and setting motor 134 to the 2.3 cubic inch per revolution setting. In this mode, mechanism 2 rotates at a lower torque, and higher speed. Motor 134 provides the force for rotating shaft 150 while motor 132 follows the action of motor 134 because it is at the zero cubic inches per revolution displacement setting. This higher speed mode can be utilized to remove bowl 46 from adjustment ring 55 for maintenance operations. Preferably, the settings provided can allow the bowl to be removed in fifteen minutes or less for a HP700 rock crusher.

A user can make finer adjustments under load or under no load conditions via logic selector 130. Logic selector 130 can set motor 132 to a displacement setting of 2.8 cubic inches per revolution and motor 134 to a displacement setting of 2.8 cubic inches per revolution. At these settings, motors 132 and 134 provide a higher torque, lower speed mode of operation. This mode can be utilized to provide finer adjustments to the position of the bowl with respect to the frame. In this way, mechanism 2 advantageously can turn bowl 46 at a slower speed for adjusting under load and a faster speed for bowl installation and removal. Preferably, motors 132 and 134 utilize a triple reduction gear reducer.

Mechanism 2 can utilize a single motor with two displacement settings. However, system 2 shown in FIG. 3 advantageously uses two motors so greater torque is available and a smaller sized hydraulic fluid source 6 can be utilized.

Figure 4:
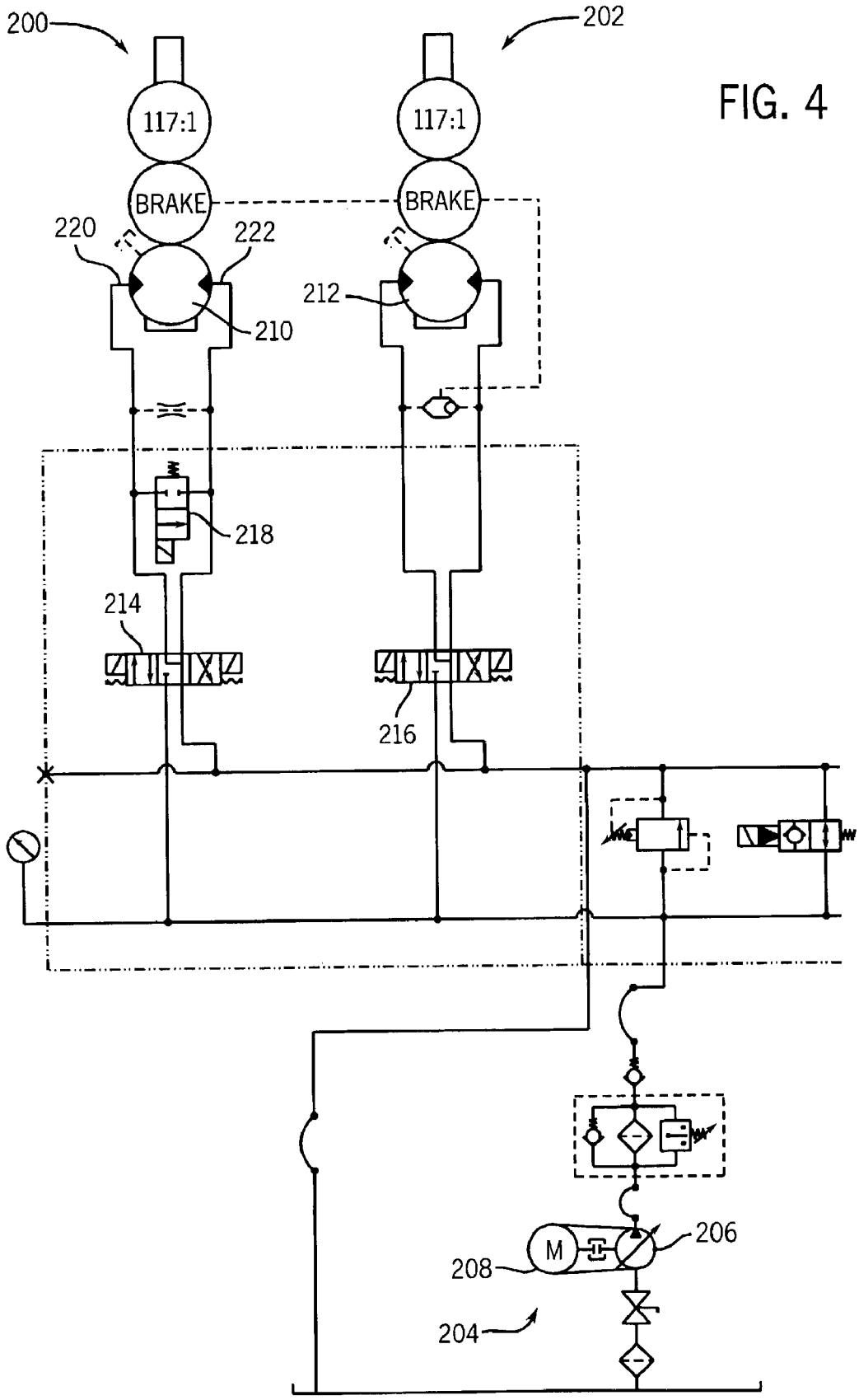
FIG. 4 is a detailed hydraulic schematic diagram of a rock crushing system of an additional exemplary embodiment.

Referring to FIG. 4, in another exemplary embodiment, a pair of hydraulic drive assemblies 200, 202 are driven by hydraulic fluid provided by a hydraulic power unit 204. The hydraulic power unit 204 may include a hydraulic pump 206 and an electric motor 208 as described in earlier embodiments.

The hydraulic drive assemblies 200, 202 may be coupled to the bowl in a similar fashion to the embodiments described above. The hydraulic drive assemblies 200, 202 may include fixed displacement hydraulic motors 210, 212. In a preferred embodiment, the fixed displacement hydraulic motors 210, 212 are piston type motors having a displacement setting of 2.44 cubic inches per revolution. In other embodiments, the hydraulic motors may be internal gear, spur gear or vane type motors.

Further referring to FIG. 4, hydraulic control valves 214, 216 are utilized to control the direction of motors 210, 212 and control whether the motors 210, 212 are operating via the provision of pressurized hydraulic fluid.

When both fixed displacement hydraulic motors 210, 212 are in service or operating, that is, they are provided with hydraulic fluid from the hydraulic power unit 204, a maximum amount of torque is provided for adjusting the bowl during operation. Generally, the maximum amount of torque is desired when the crushing gap is being adjusted during crusher operation. During operation, rocks are present, thus increasing the friction between the bowl and head assembly, requiring greater torque.

During maintenance of the crusher, it may be desired to increase the speed of bowl rotation to more quickly remove the bowl from the adjustment ring. In order to increase the speed of bowl adjustment, one fixed displacement hydraulic motor 210 may be taken out of operation by de-energizing hydraulic control valve 214. The term "taken out of operation" does not necessarily mean that the motor is removed from the crusher, or even disengaged from the bowl, rather, terminating the supply of hydraulic fluid will remove the motor from operation. When motor 210 is removed from operation, the hydraulic fluid provided by hydraulic power unit 204 is diverted to fixed displacement hydraulic motor 212, thus increasing the flow rate to and therefore speed of hydraulic motor 212.

In a preferred embodiment where hydraulic motors 210, 212 are of the same size, removing motor 210 from operation will double the speed of motor 212, if the flow rate of hydraulic fluid provided by the hydraulic power unit 204 remains constant, which is the case in a preferred embodiment. Note that while the two fixed displacement motors 210, 212 are the same size in a preferred embodiment, the motors may be of different sizes depending on the crusher configuration.

Note that removing hydraulic motor 210 from operation to double the speed of bowl adjustment with hydraulic motor 212 results in decreasing the available adjustment torque. The available torque is decreased by half in the case where motors 210, 212 are of the same size. The decrease in torque is acceptable in the case of bowl adjustment and removal during maintenance operations as the required torque to rotate the bowl during such operations when materials are not in the crushing gap is substantially less. Accordingly, sacrificing torque to increase the speed of bowl adjustment is both acceptable and desirable.

In an exemplary embodiment, a hydraulic idling valve 218 is provided to connect the hydraulic motor ports 220, 222 of the hydraulic motor 210 that is taken out of operation. Utilizing the hydraulic idling valve 218 permits motor 210 to remain engaged with the adjustment gear even when out of service without creating a resisting torque, as fluid may flow in a loop as the bowl is rotated.

The use of fixed displacement hydraulic motors 210, 212 as shown in FIG. 4 may provide certain advantages over the use of variable displacement hydraulic motors as depicted in FIG. 3. The primary advantage of fixed displacement hydraulic motors is that such motors are somewhat less expensive than variable displacement motors and can be lighter weight and therefore more easily supported on the crusher. The fixed displacement motors are also more durable and tend to be more stable in operation.

Although two fixed displacement motors 210, 212 are depicted in FIG. 4, other exemplary embodiments may have a greater number of motors, such as four motors. In such embodiments, it may be necessary to provide an additional pump and motor combination to the hydraulic power unit. In embodiments having more than two fixed displacement motors, taking one or more of the motors out of service while maintaining the same hydraulic fluid flow rate from the hydraulic power unit will increase the speed of bowl adjustment while sacrificing torque. Conversely, increased torque may be provided by adding formerly non-operating motors to operation without changing the flow from the hydraulic power unit, thus increasing torque while decreasing the speed of bowl adjustment.

It is understood that the above description is of preferred exemplary embodiment of the present invention. The present invention is not limited to the specific form shown. For example, although a dual motor system is shown, a single variable displacement motor or more than two fixed displacement motors can be utilized. Also, the specific displacement settings given are merely examples. These and other modifications may be made in the design and arrangement of the elements discussed here without departing from the scope of the invention as expressed in the appended claims.

What is claimed is:

1. A method of adjusting a bowl with respect to a frame in a cone crusher, comprising the steps of:

providing a plurality of hydraulic motors adapted to rotate the bowl with respect to the frame;

providing at least one hydraulic pump adapted to provide fluid to the hydraulic motors;

setting a first adjustment speed having a first torque by operating more than one motor and the at least one hydraulic pump; and setting a second adjustment speed having a second torque by removing one of the operating motors from operation while maintaining operation of the at least one hydraulic pump;

wherein the second adjustment speed is greater than the first adjustment speed and the second torque is less than the first torque.

2. The method of claim 1, wherein the at least one hydraulic pump is driven by an electric motor.

3. The method of claim 1, wherein the plurality of hydraulic motors is two.

4. The method of claim 1, wherein the plurality of hydraulic motors are fixed displacement hydraulic motors.

5. The method of claim 1, wherein the plurality of hydraulic motors are variable displacement hydraulic motors.

6. The method of claim 1, further comprising the step of setting a third adjustment speed by removing a second hydraulic motor from operation.

7. A cone crusher, comprising:

a frame;

a bowl coupled to the frame;

a head assembly coupled to the frame defining a crushing gap between the head assembly and the bowl;

a plurality of fixed displacement hydraulic motors adapted to rotate the bowl with respect to the frame;

a hydraulic fluid source providing a flow rate of hydraulic fluid to the plurality of hydraulic motors; and a hydraulic control valve adapted to remove one of the plurality of hydraulic motors from operation wherein the hydraulic fluid is directed to the remaining hydraulic motors, wherein the flow rate of hydraulic fluid remains unchanged, thereby increasing the hydraulic fluid flow rate provided to and speed of the remaining hydraulic motors.

8. The cone crusher of claim 7, wherein the hydraulic fluid source is a hydraulic pump driven by an electric motor.

9. The cone crusher of claim 8, wherein the hydraulic fluid source comprises a plurality of hydraulic pumps.

10. The cone crusher of claim 7, further comprising an adjustment ring fixed to the frame and wherein the bowl is rotatably coupled to the adjustment ring via threads.

11. The cone crusher of claim 7, wherein the plurality of fixed displacement hydraulic motors is two fixed displacement motors.

12. The cone crusher of claim 7, wherein the fixed displacement hydraulic motors are piston type motors.

13. The cone crusher of claim 12, further comprising an inlet port and an outlet port for the hydraulic motor that is removed from operation, wherein the inlet port and the outlet port are connected when the motor is taken out of operation.

14. A method of increasing the torque available for adjusting a crushing gap in a cone crusher having a bowl and a frame, comprising the steps of:

providing more than one fixed displacement hydraulic motor adapted to rotate the bowl with respect to the frame, at least one of the hydraulic motors not operating, the remaining hydraulic motors being operating hydraulic motors;

providing a hydraulic fluid source to provide a flow rate of hydraulic fluid to the operating hydraulic motors; and placing the not operating hydraulic motor into operation by providing a portion of the flow rate of hydraulic fluid to the not operating hydraulic motor, the flow rate of hydraulic fluid from the hydraulic fluid source remaining unchanged, thereby increasing the torque available for adjusting the crushing gap.

15. The method of claim 14, wherein the hydraulic fluid source comprises a hydraulic pump driven by an electric motor.

16. The method of claim 14, wherein two fixed displacement motors are provided.

17. The method of claim 16, wherein the two fixed displacement motors are piston type motors.

18. The method of claim 16, wherein the two fixed displacement motors are the same size, resulting in a doubling of the available torque when the out of operation motor is placed into operation.

19. The method of claim 18, wherein the two fixed displacement motors have a displacement of 2.44 cubic inches per revolution.

20. The method of claim 14, further comprising the step of opening a hydraulic control valve to provide hydraulic fluid to the out of operation hydraulic motor.

* * * * *